US008401453B2

(12) United States Patent
Koido

(10) Patent No.: US 8,401,453 B2
(45) Date of Patent: Mar. 19, 2013

(54) CLEANING DEVICE AND IMAGE FORMING APPARATUS

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 290 days.

(21) Appl. No.: 12/857,845

(22) Filed: Aug. 17, 2010

(65) Prior Publication Data

US 2011/0052288 A1 Mar. 3, 2011

(30) Foreign Application Priority Data

Aug. 31, 2009 (JP) ..... 2009-200555

(51) Int. Cl.
*G03G 21/00* (2006.01)

(52) U.S. Cl. ..... 399/351

(58) Field of Classification Search ..... 399/123, 399/343, 350, 351; 15/1.51, 256.5, 256.51, 15/256.52
See application file for complete search history.

(56) References Cited

U.S. PATENT DOCUMENTS

| | | | | |
|---|---|---|---|---|
| 6,701,123 | B2 * | 3/2004 | Endo et al. | 399/350 |
| 7,292,816 | B2 * | 11/2007 | Ojimi et al. | 399/346 |
| 7,295,802 | B2 * | 11/2007 | Kabata et al. | 399/351 |

FOREIGN PATENT DOCUMENTS

| | | |
|---|---|---|
| JP | 04-172486 A | 6/1992 |
| JP | A-08-063062 | 3/1996 |
| JP | A-2001-125458 | 5/2001 |
| JP | A-2004-177935 | 6/2004 |
| JP | A-2007-206602 | 8/2007 |
| JP | A-2008-102322 | 5/2008 |

* cited by examiner

*Primary Examiner* — Hoan Tran
(74) *Attorney, Agent, or Firm* — Posz Law Group, PLC

(57) ABSTRACT

A cleaning device includes a developer removal member, a support member and a fixation member. The developer removal member is in contact with an adherend to which developer adheres and removes the developer from the adherend. The support member has a first end where a bent portion is formed and a second end opposite to the first end. The support member also supports the developer removal member in the vicinity of the bent portion. The fixation member holds the second end of the support member.

20 Claims, 15 Drawing Sheets

TRANSPORT DIRECTION

FIG. 7A

| | PLATE SPRING | | | | | | | | |
|---|---|---|---|---|---|---|---|---|---|
| | MATERIAL | SHAPE | YOUNG'S MODULUS Es [kgf/mm$^2$] | THICKNESS ts [mm] | LENGTH Ls [mm] | FREE LENGTH hs [mm] | LENGTH OF BENT PORTION Zs [mm] | AMOUNT OF DEFLECTION ys [mm] | LINEAR PRESSURE Ws [gf/mm] |
| SPECIFICATION 1-1 | STAINLESS | L | 19000 | 0.08 | 240 | 13.0 | 1.5 | 1.81 | 2.0 |
| SPECIFICATION 1-2 | STAINLESS | L | 19000 | 0.08 | 240 | 13.0 | 1.5 | 1.44 | 1.6 |
| COMPARISON SPECIFICATION 1-1 | STAINLESS | FLAT | 19000 | 0.08 | 240 | 13.0 | — | 1.81 | 2.0 |
| COMPARISON SPECIFICATION 1-2 | STAINLESS | FLAT | 19000 | 0.08 | 240 | 13.0 | — | 1.44 | 1.6 |

FIG. 7B

| | CLEANING MEMBER | | | | | | | | TEST ENVIRONMENT |
|---|---|---|---|---|---|---|---|---|---|
| | MATERIAL | SHAPE | YOUNG'S MODULUS Eb [kgf/mm$^2$] | THICKNESS Tb [mm] | LENGTH Lb [mm] | FREE LENGTH hb [mm] | AMOUNT OF DEFLECTION yb [mm] | LINEAR PRESSURE Wb [gf/mm] | |
| COMPARISON SPECIFICATION 1-3 | URETHANE RUBBER | FLAT | 0.67 | 1.6 | 240 | 7.0 | 1.00 | 2.0 | 25°C/50% |
| | | | 0.80 | 1.6 | 240 | 7.0 | 1.00 | 2.4 | 5°C/10% |

FIG. 8

| TEST CONDITION | 1 | 2 | 3 | 4 | ACCEPTANCE |
|---|---|---|---|---|---|
| TEST ENVIRONMENT | 25°C/50% | 5°C/10% | 25°C/50% | 5°C/10% | |
| TONER AVERAGE PARTICLE SIZE | 5.0 μm | 5.0 μm | 4.0 μm | 4.0 μm | |
| SPECIFICATION 1-1 | ◎ | ◎ | ◎ | ◎ | OK |
| SPECIFICATION 1-2 | ◎ | ◎ | ◎ | ○ | OK |
| COMPARISON SPECIFICATION 1-1 | ◎ | × | ○ | × | NG |
| COMPARISON SPECIFICATION 1-2 | ○ | ○ | ○ | × | NG |
| COMPARISON SPECIFICATION 1-3 | ○ | × | × | × | NG |

◎ : NO IMAGE DEFECT, NO TONER ADHESION
○ : NO IMAGE DEFECT, SLIGHT TONER ADHESION
× : IMAGE DEFECTS, TONER ADHESION

FIG. 14

| | PLATE SPRING | | | | | | | | | |
|---|---|---|---|---|---|---|---|---|---|---|
| | MATERIAL | SHAPE | YOUNG'S MODULUS Es [kgf/mm$^2$] | THICKNESS ts [mm] | LENGTH Ls [mm] | FREE LENGTH hs [mm] | LENGTH OF BENT PORTION Zs [mm] | AMOUNT OF DEFLECTION ys [mm] | | |
| SPECIFICATION 2-1 | STAINLESS | L (EMBEDDED BENT PORTION) | 19000 | 0.08 | 240 | 13.0 | 1.5 | 1.05 | 1.44 | 1.81 |
| COMPARISON SPECIFICATION 2-1 (SPECIFICATION 1-1) | STAINLESS | L | 19000 | 0.08 | 240 | 13.0 | 1.5 | 1.05 | 1.44 | 1.81 |

FIG. 15

| | AMOUNT OF DEFLECTION ys [mm] | CLEANING PERFORMANCE | AMOUNT OF ABRASION OF PHOTOSENSITIVE DRUM ⊿d [μm] | IMAGE DETERIORATION | ACCEPTANCE |
|---|---|---|---|---|---|
| SPECIFICATION 2-1 | 1.05 | ◎ | 5.1 | ○ | OK |
| | 1.44 | ◎ | 6.0 | ○ | |
| | 1.80 | ◎ | 6.9 | ○ | |
| COMPARISON SPECIFICATION 2-1 (SPECIFICATION 1-1) | 1.05 | × | 6.0 | ○ | NG |
| | 1.44 | ○ | 8.3 | △ | |
| | 1.80 | ◎ | 9.9 | × | |

CLEANING PERFORMANCE

◎ : NO IMAGE DEFECT, NO TONER ADHESION

○ : NO IMAGE DEFECT, SLIGHT TONER ADHESION

× : IMAGE DEFECTS, TONER ADHESION

IMAGE DETERIORATION

○ : NO IMAGE DETERIORATION

△ : NO IMAGE DETERIORATION, BROADER DOTS

× : IMAGE DETERIORAITON

CLEANING DEVICE AND IMAGE FORMING APPARATUS

CROSS-REFERENCE TO RELATED APPLICATION

This application claims priority under 35 USC 119 from prior Japanese Patent Application No. P 2009-200555 filed on Aug. 31, 2009, the entire contents of which are incorporated herein by reference.

BACKGROUND

This application relates to a cleaning device for use in an image forming apparatus that employs electrophotographic technology, such as a printer, a copier or a facsimile machine. The application also relates to an image forming apparatus including the cleaning device.

A conventional image forming apparatus incorporates a cleaning device therein. The cleaning device removes residual toner that remains on a photosensitive drum after a toner image is transferred to a print medium. A cleaning device that has a cleaning blade made of rubber is well known. In this cleaning device, the cleaning blade mechanically scrapes residual toner from the photosensitive drum. Japanese Patent Laid-Open No. 4-172486 discloses one such cleaning device.

The cleaning device disclosed in the publication No. 4-172486 includes a cleaning blade, a plate spring and a blade-fixing bracket. The cleaning blade, which is made of rubber, is in contact with a photosensitive drum and extends in a longitudinal direction thereof. The plate spring supports the cleaning blade on its first surface and is attached to the blade-fixing bracket at its second surface, which is opposite to the first surface.

In the aforementioned cleaning device, however, the rigidity of the cleaning blade is liable to vary depending on the usage environment of the image forming apparatus in which the cleaning device is installed, which results in bending, or deformation, of the cleaning blade in a manner such that the cleaning blade departs from linearity in the longitudinal direction and such that the cleaning blade is no longer parallel to the axis of the drum. If the cleaning blade is so deformed, the pressure of the cleaning blade against the photosensitive drum varies, which causes residual toner that has a small average particle size to pass between the cleaning blade and the photosensitive drum. This will cause insufficient cleaning, resulting in loss of print quality.

SUMMARY

An object of the application is to disclose a cleaning device and an image forming apparatus, which are capable of preventing bending, or deformation, of a cleaning member in a direction such that a longitudinal axis of the cleaning member is no longer linear and no longer parallel to the axis of the drum, which causes loss of print quality.

According to one aspect, a cleaning device includes a developer removal member, a support member and a fixation member. The developer removal member is in contact with an adherend to which developer adheres and removes the developer from the adherend. The support member has a first end where a bent portion is formed and a second end opposite to the first end. The support member also supports the developer removal member in the vicinity of the bent portion. The fixation member holds the second end of the support member.

According to another aspect, an image forming apparatus includes an adherend, a developer removal member, a support member and a fixation member. Developer adheres to the adherend. The developer removal member is in contact with the adherend and removes the developer from the adherend. The support member has a first end where a bent portion is formed and a second end opposite to the first end. The support member also supports the developer removal member in the vicinity of the bent portion. The fixation member holds the second end of the support member.

In another aspect, the cleaning device includes a developer removal member, which is adapted to contact a movable surface to which developer adheres. The developer removal member has a longitudinal axis, which is transverse to a moving direction of the movable surface. The developer removal member wipes and removes the developer from the movable surface. The cleaning device further includes a plate spring, which includes a fixed side, a movable side, and a bent portion. The fixed side is opposite to the movable side. The developer removal member is fixed to the movable side of the plate spring. The plate spring includes a body member and the bent portion. The bent portion is located at the movable side of the plate spring, is proximal to and substantially coextensive with the developer removal member, and extends generally at a right angle with respect to the body member. The cleaning device further includes a fixation member that holds the fixed side of the plate spring in a stationary position.

The full scope of applicability of the cleaning device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The cleaning device and the image forming apparatus will become more fully understood from the following detailed description with reference to the accompanying drawings, which are given by way of illustration only, and thus not to limit the invention, and wherein:

FIG. 7A is a first table showing specification of cleaning units used in the evaluation tests of the first embodiment;

FIG. 7B is a second table showing specification of the cleaning units used in the evaluation tests of the first embodiment;

FIG. 8 is a table showing results of the evaluation tests of the first embodiment;

FIG. 14 is a table showing specification of cleaning units used in evaluation tests of the second embodiment; and FIG. 15 is a table showing results of the evaluation tests of the second embodiment.

DETAILED DESCRIPTION

Preferred embodiments of a cleaning device and an image forming apparatus according to the invention will be described in detail with reference to the accompanying drawings. In each embodiment, the description will be given with an electrophotographic printer as an image forming apparatus.

First Embodiment

Figure 1:
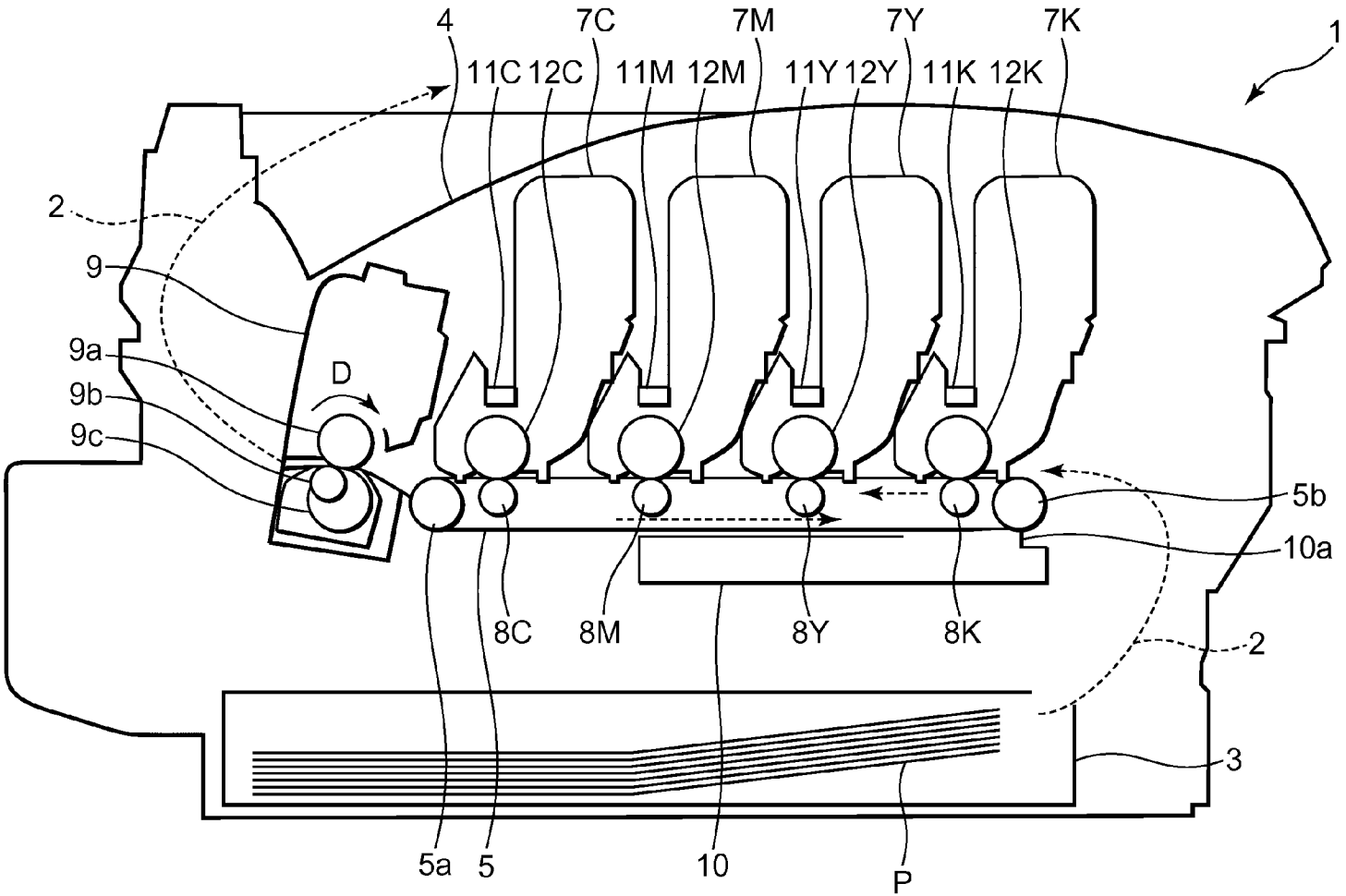
FIG. 1 is a schematic view of a printer of a first embodiment.

FIG. 1 is a schematic view of a printer 1 of a first embodiment, which includes a sheet path 2, a sheet cassette 3, a stacker 4, a transport belt 5, image-forming units 7 (7K, 7Y, 7M and 7C), transfer rollers 8 (8K, 8Y, 8M and 8C), a fixing unit 9, a waste toner container 10 and exposure heads 11 (11K, 11Y, 11M and 11C).

The sheet path 2 is substantially S-shaped. The sheet cassette 3 is provided at one end of the sheet path 2 and the stacker 4 is provided at the other end of the sheet path 2. The sheet cassette 3 is detachably mounted to the printer 1 and accommodates a stack of sheets P as print media therein. The stacker 4 holds the sheet P on which an image is formed. The sheet P accommodated in the sheet cassette 3 is picked up one by one from the sheet cassette 3 and transported toward the transport belt 5 along the sheet path 2. The transport belt 5, which is entrained about a drive roller 5*a* and a tension roller 5*b*, transports the sheet P while electrostatically adhering the sheet P thereon.

The image-forming units 7K, 7Y, 7M and 7C, which are detachably mounted to the printer 1, respectively form a black toner image, a yellow toner image, a magenta toner image and a cyan toner image. Each of the image-forming units 7K, 7Y, 7M and 7C detachably incorporates a toner cartridge as a developer container that stores toner of the corresponding color. That is to say, the image-forming unit 7K incorporates a toner cartridge storing black toner. The image-forming unit 7Y incorporates a toner cartridge storing yellow toner. The image-forming unit 7M incorporates a toner cartridge storing magenta toner. The image-forming unit 7C incorporates a toner cartridge storing cyan toner.

The transfer rollers 8K, 8Y, 8M and 8C are respectively opposed to the image-forming units 7K, 7Y, 7M and 7C through the transport belt 5. The transfer roller 8K transfers the black toner image formed by the image-forming unit 7K to the sheet P transported on the transport belt 5. Therefore, a voltage is applied to the transfer roller 8K from a high-voltage supply, not shown, so that an electric field for transferring the black toner image to the sheet P is generated. Similarly to the transfer roller 8K, the transfer rollers 8Y, 8M and 8C respectively transfer the yellow toner image formed by the image-forming unit 7Y, the magenta toner image formed by the image-forming unit 7M and the cyan toner image formed by the image-forming unit 7C, to the sheet P transported on the transport belt 5.

The fixing unit 9 may include a heat roller 9*a* and a pressure roller 9*b* around which a pressure belt 9*c* is wrapped. The fixing unit 9 fixes the toner images transferred to the sheet P by the transfer rollers 8K, 8Y, 8M and 8C, onto the sheet P with heat and pressure. The sheet P with the toner images thereon is transported along the sheet path 2 and delivered to the stacker 4. The waste toner container 10 collects toner scraped from the transport belt 5 by a belt cleaning blade 10*a*.

Each of the exposure heads 11K, 11Y, 11M and 11C may include multiple LEDs (Light Emitting Diodes) as light-emitting elements arranged in a main scanning direction, and a lens array. The exposure head 11K is opposed to a photosensitive drum 12K, described later, so that light emitted from the LEDs is focused onto a surface of the photosensitive drum 12K. The electric potential of a surface portion of the photosensitive drum 12K exposed to the light from the exposure head 11K is attenuated and an electrostatic latent image is formed on the surface of the photosensitive drum 12K. Similarly to the exposure head 11K, the exposure heads 11Y, 11M and 11C respectively form electrostatic latent images on surfaces of photosensitive drums 12Y, 12M and 12C.

Next, the image-forming units 7K, 7Y, 7M and 7C will be described in detail. Because the image-forming units 7K, 7Y, 7M and 7C have the same structures, except for toner colors, the image-forming unit 7K forming a black toner image will be described by way of example here.

Figure 2:
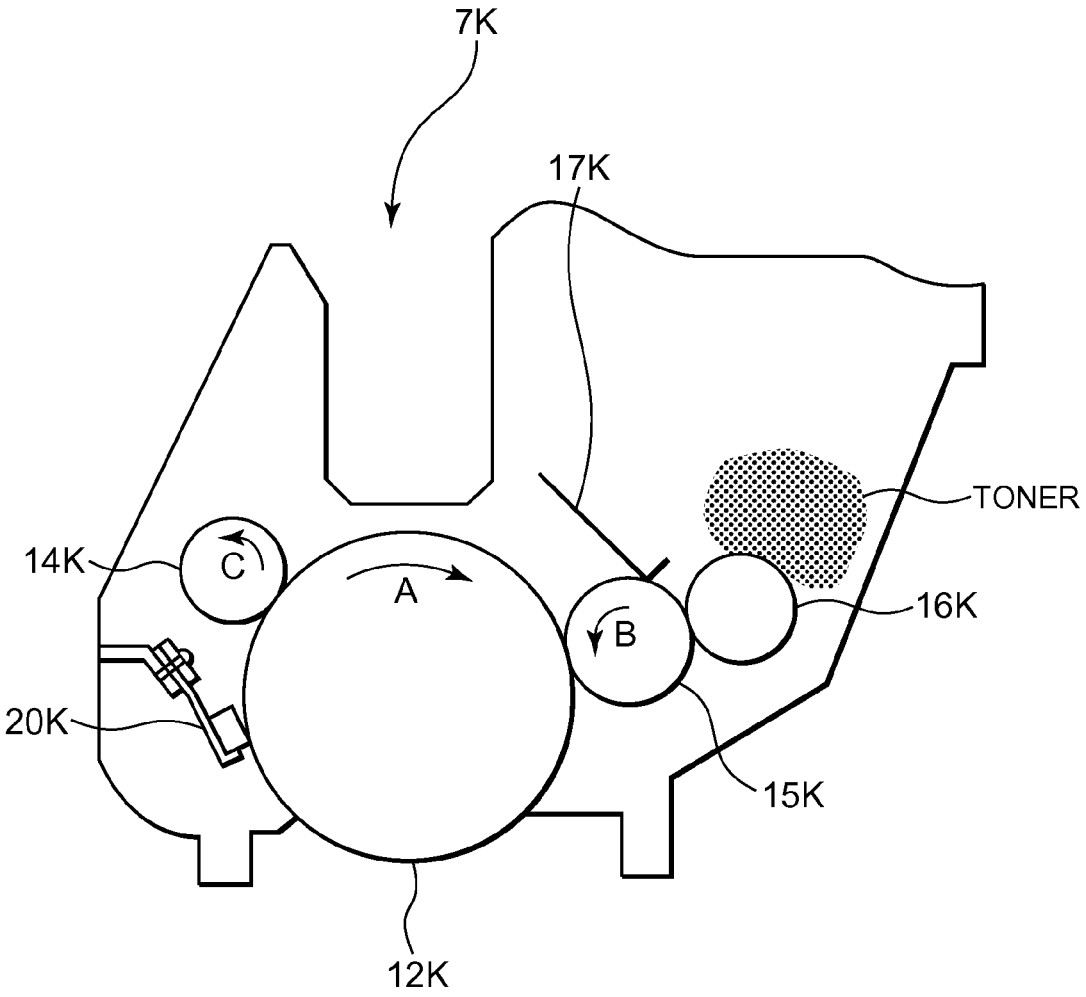
FIG. 2 is a schematic view of an image-forming unit of the first embodiment.

FIG. 2 is a schematic view of the image-forming unit 7K, which may include the photosensitive drum 12K, a charging roller 14K, a developing roller 15K, a supply roller 16K, a developing blade 17K and a cleaning unit 20K. The charging roller 14K, the developing roller 15*k* and the supply roller 16K are connected to corresponding high-voltage supplies when the image-forming unit 7K is mounted to the printer 1.

The photosensitive drum 12K as an image bearing body is composed of an aluminum cylinder as a conductive support coated with a photoconductive resin layer, which is made of a stack of a charge generation layer and a charge transport layer. The photosensitive drum 12K has an axis of rotation that extends in a direction perpendicular to the transport direction of the sheet P, i.e., in its longitudinal direction. The photosensitive drum 12K rotates in the direction shown by an arrow A at a uniform rate with a driving force from a drive unit, not shown. The photosensitive drum 12K may be an inorganic photosensitive drum composed of an aluminum cylinder coated with a photoconductive layer made of selenium, amorphous silicon or the like. The photosensitive drum 12K also may be an organic photosensitive drum composed of an aluminum cylinder coated with an organic photoconductive layer made of binder resin in which a charge generation agent and a charge transport agent are dispersed.

The charging roller 14K as a charging member is composed of a metallic shaft coated with a semi-conductive rubber layer made of semi-conductive epichlorohydrin rubber or the like. The charging roller 14K is opposed to and in contact with the surface of the photosensitive drum 12K, and is rotated by the photosensitive drum 12K in the direction shown by an arrow C. The charging roller 14K uniformly charges the surface of the photosensitive drum 12K by applying a direct voltage received from a high-voltage supply, not shown, thereto.

The developing roller 15K as a developer bearing member is composed of a metallic shaft coated with a semi-conductive rubber layer made of polyurethane rubber or the like. The developing roller 15K is opposed to and in contact with the surface of the photosensitive drum 12K. The developing roller 15K receives a voltage from a high-voltage supply, not shown, so as to generate an electric field by which toner supplied from the supply roller 16K is adsorbed onto a surface thereof. The developing roller 15K carries the toner toward the photosensitive drum 12K in the direction shown by an arrow B, and develops an electrostatic latent image on the photosensitive drum 12K with the toner by reversal development, thereby forming a toner image on the photosensitive drum 12K.

The supply roller 16K as a developer supply member is composed of a metallic shaft coated with a foamed sponge layer made of a semi-conductive foamed silicone sponge or the like. The supply roller 16K is opposed to and in contact with the surface of the developing roller 15K. The supply roller 16K receives a voltage from a high-voltage supply, not shown, so as to generate an electric field by which the toner on the supply roller 16K is supplied to the developing roller 15K.

The developing blade 17K as a developer-layer-forming member is made of an elastic material such as stainless steel. The developing blade 17K has a bent portion at its one end opposed to the photosensitive drum 12K. The bent portion is in contact with the developing roller 15K on the downstream side of the supply roller 16K and on the upstream side of the photosensitive drum 12K in the direction B. The developing blade 17K is in sliding contact with the developing roller 15K while pressing the surface of the developing roller 15K to form the toner on the developing roller 15K into a toner layer that has a uniform thickness.

Figure 3:
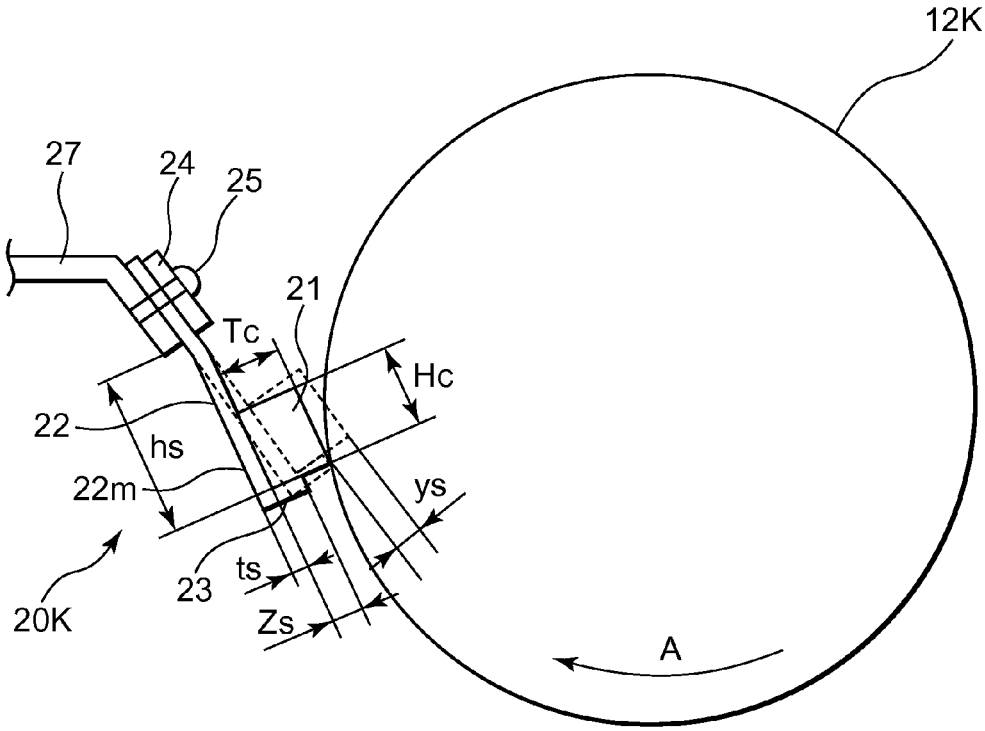
FIG. 3 is a schematic view of a cleaning unit of the first embodiment.
Figure 4:
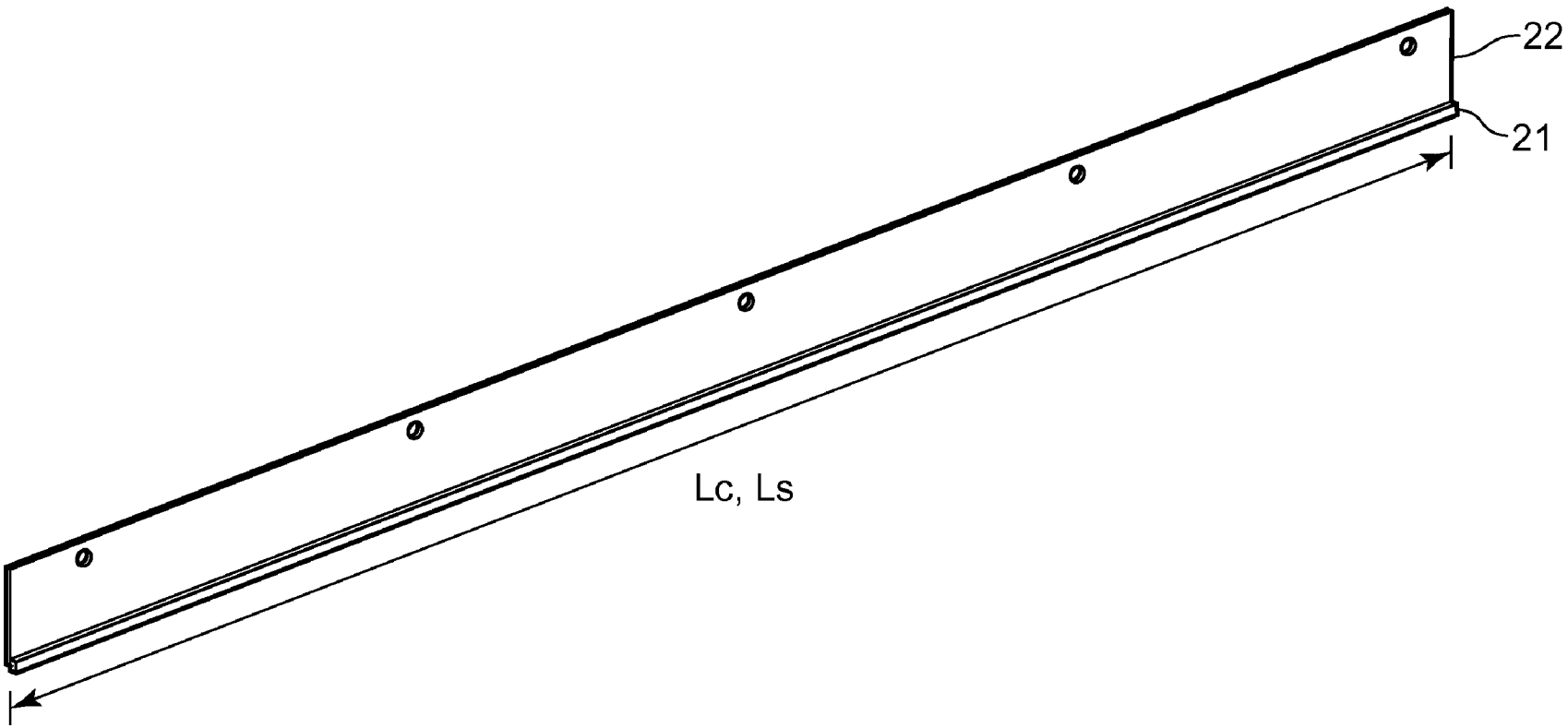
FIG. 4 is a perspective view of a cleaning member and a plate spring of the cleaning unit of the first embodiment.
Figure 5:
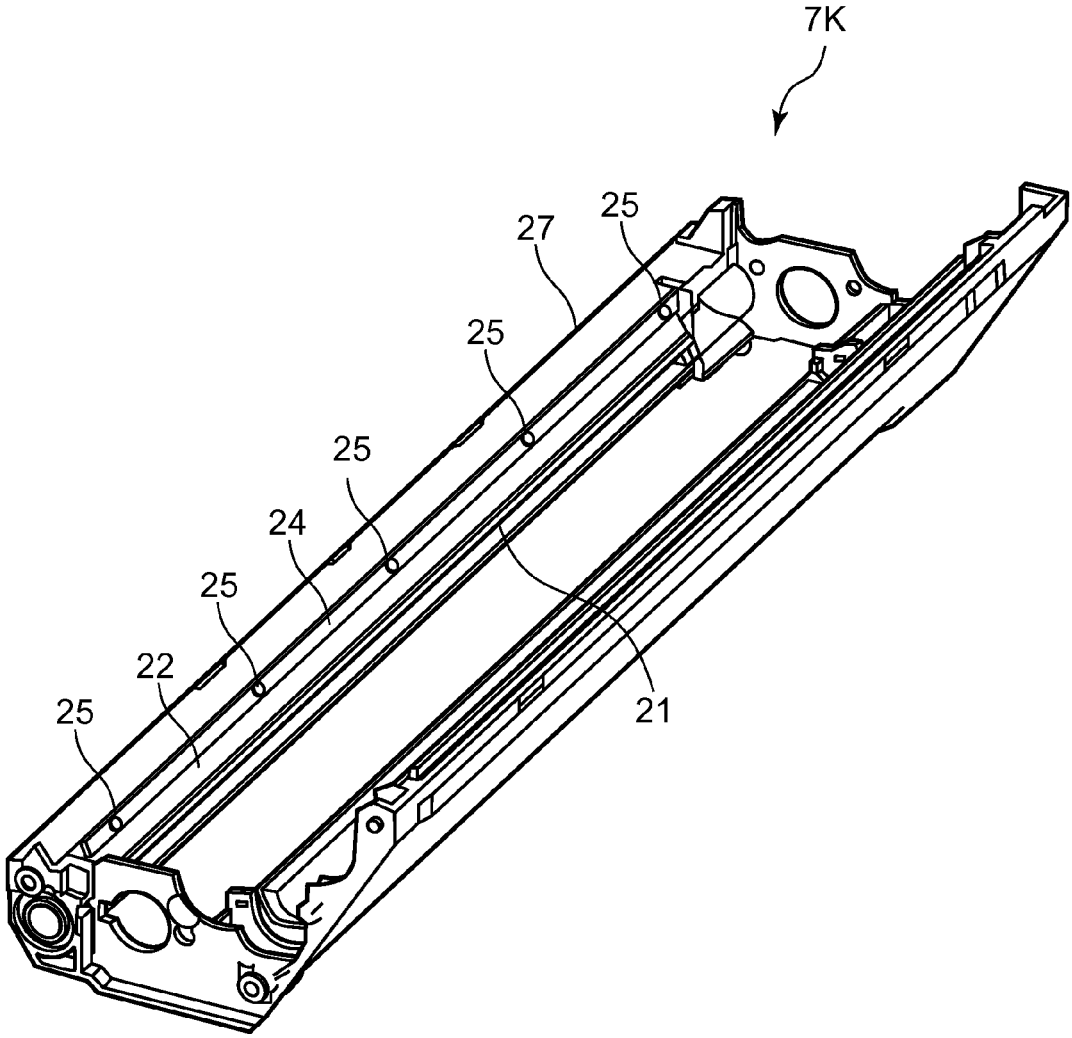
FIG. 5 is a perspective view of the image-forming unit in which the cleaning unit of the first embodiment is incorporated.

Next, the cleaning unit 20K will be described in detail. FIG. 3 is a schematic view of the cleaning unit 20K, which includes a cleaning member 21, a plate spring 22 and a base frame 27. FIG. 4 is a perspective view of the cleaning member 21 and the plate spring 22 of the cleaning unit 20K. FIG. 5 is a perspective view of the image-forming unit 7K in which the cleaning unit 20K is incorporated.

The cleaning member 21, or developer removal member, is in sliding contact with the photosensitive drum 12K. As shown in FIG. 4, the cleaning member 21, which has elasticity, is substantially rectangular in shape. The cleaning member 21 has a length Lc that is substantially the same as the length of the photosensitive drum 12K in its longitudinal direction. The cleaning member 21 may be made of urethane rubber, epoxy rubber, acrylic rubber, fluorine resin rubber, nitrile-butadiene rubber (NBR), styrene-butadiene rubber (SBR), isoprene rubber (IR) or polybutadiene rubber. In FIG. 3, symbols Hc and Tc respectively denote the width and the thickness of the cleaning member 21.

The plate spring 22 serves as a support member, which supports the cleaning member 21, is flexible and is substantially L-shaped in cross-section as shown in FIG. 3. That is to say, one end of the plate spring 22 is bent approximately at a right angle. In addition, as shown in FIG. 4, the plate spring 22 has a length Ls that is substantially the same as the length of the photosensitive drum 12K in its longitudinal direction. The plate spring 22 may be made of stainless steel or phosphor bronze. In the first embodiment, the plate spring 22 is made of stainless steel.

As shown in FIG. 3, the plate spring 22 has a bent portion 23 at a first end, i.e., a free end, opposed to the photosensitive drum 12K. The plate spring 22 has essentially two parts, a body member 22*m* and the bent portion 23. The bent portion 23 extends approximately at a right angle with respect to the body member 22*m*. An inner surface of the bent portion 23 and a surface of the cleaning member 21 that faces the inner surface of the bent portion 23 are attached to each other with a hot-melt adhesive. The cleaning member 21 and the bent portion 23 are coextensive and have substantially the same length in the longitudinal direction of the plate spring 22. A second end of the plate spring 22, which is opposite to the first end (the free end), is sandwiched between the base frame 27, which serves as a fixation member, and a fixation plate 24. The second end is fixed to the base frame 27 with a screw 25. In FIG. 3, a symbol hs denotes a distance between an end of the base frame 27 and the first end (the free end) of the plate spring 22, i.e., a free length of the plate spring 22. In addition, symbols ys and is respectively denote the amount of deflection and the thickness of the plate spring 22, and a symbol Zs denotes the length of the bent portion 23.

In the cleaning unit 20K of the first embodiment, the plate spring 22 has the bent portion 23 at the free end to enhance the rigidity of the plate spring 22, which prevents bending of the cleaning member 21. That is, the bent portion 23 serves to keep the cleaning member 21 linear and parallel to the axis of the photosensitive drum 12K. Therefore, the cleaning unit 20K is capable of preventing the variation in pressure of the cleaning member 21 against the photosensitive drum 12K and is capable of preventing residual toner on the photosensitive drum 12K from passing between the cleaning member 21 and the photosensitive drum 12K even if the residual toner has a small average particle size.

The cleaning member 21 supported on the plate spring 22 is disposed so that the longitudinal directions of the cleaning member 21 and the photosensitive drum 12K are parallel with each other, and a corner portion of the cleaning member 21 is urged against the surface of the photosensitive drum 12K by elasticity of the plate spring 22. The cleaning member 21 scrapes the residual toner from the photosensitive drum 12K when the photosensitive drum 12K rotates. Therefore, the surface of the photosensitive drum 12K, which lies downstream of a contact portion between the cleaning member 21 and the photosensitive drum 12K in the rotational direction A, is maintained in a substantially toner-free condition. The residual toner scraped from the photosensitive drum 12K by the cleaning member 21 is conveyed to a waste toner chamber of the toner cartridge by a spiral conveyer, not shown.

Next, toner of the first embodiment will be described. The toner is composed of a mother particle that contains at least binder resin, and an external additive added to the mother particle. The binder resin may be, but not limited to, polyester resin, styrene-acrylic resin, epoxy resin or styrene-butadiene resin. The external additive may be an inorganic fine powder or an organic fine powder.

A colorant may be, but not limited to, a dye or a pigment, which is commonly used for black toner, yellow toner, magenta toner and cyan toner. More specifically, the colorant may be carbon black, iron oxide, Permanent Brown FG, Pigment Green B, Pigment Blue 15:3, Solvent Blue 35, Solvent Red 49, Solvent Red 146, quinacridone, Carmine 6B, Disazo Yellow or isoindoline. The colorant is added 2 to 25 parts by weight, preferably 2 to 15 parts by weight, per 100 parts by weight of the binder resin. In addition, the colorant may be used alone or in combination.

A release agent may be, but not limited to, low-molecular-weight polyethylene, low-molecular-weight polypropylene, paraffin wax or carnauba wax. The release agent is added 0.1 to 20 parts by weight, preferably 0.5 to 12 parts by weight, per 100 parts by weight of the binder resin. In addition, the release agent may be used alone or in combination.

A charge control agent may be, but not limited to, quaternary ammonium salt, azo complex, salicylic acid complex or calixarene. Quaternary ammonium salt is used as the charge control agent for positively chargeable toner. Azo complex, salicylic acid complex and calixarene are used as the charge control agent for negatively chargeable toner. The charge control agent is added 0.05 to 15 parts by weight, preferably 0.1 to 10 parts by weight, per 100 parts by weight of the binder resin.

The external additive is added to the binder resin to impart environmental stability and charge stability to the toner, and also to improve developability, flowability and shelf life of the toner. The external additive may be, but not limited to, silica, titania or alumina. The external additive is added 0.01 to 10 parts by weight, preferably 0.05 to 8 parts by weight, per 100 parts by weight of the binder resin.

Next, a method of making the toner will be described. First, 100 parts by weight of polyester resin as the binder resin, which has a glass transition temperature Tg of 62° C. and a softening temperature $T_{1/2}$ of 115° C., 0.5 parts by weight of T-77 (Hodogaya Chemical Co., Ltd.) as the charge control agent, 5.0 parts by weight of carbon black (MOGUL-L: Cabot Corp.) as the colorant, and 4.0 parts by weight of carnauba wax (carnauba wax 1: S. Kato & Co.) as the release agent are mixed with a Henschel mixer. Then, the mixture is melt kneaded with a twin-screw extruder.

After cooling, the kneaded mixture is granulated with a cutter mill that has a 2 mm aperture screen. Then, the granulated mixture is comminuted with a collision plate type mill (DISPERSION SEPARATOR: Nippon Pneumatic MFG Co., Ltd.), and is classified with an air-classifier. At this point, the mother particle is formed. Then, 100 parts by weight of the mother particle and 3.0 parts by weight of hydrophobic silica R972 (Japan Aerosil Co., Ltd.) that has an average particle size of 16 nm, are agitated with a Henschel mixer for three minutes. In this manner, the toner that has an average particle size of 5.0 μm is made. In addition, the average particle size of the toner can be measured with a particle size distribution analyzer (COULTER MULTISIZER 3: Beckman Coulter, Inc.), which has an aperture size of 100 μm.

Next, a developing operation of the image-forming unit 7K to form a toner image on the photosensitive drum 12K will be described. As shown in FIG. 2, the photosensitive drum 12K rotates in the direction A at a uniform rate. While being rotated by the photosensitive drum 12K in the direction C, the charging roller 14K applies a direct voltage, received from a high-voltage supply, not shown, to the surface of the photosensitive drum 12K, thereby uniformly charging the surface of the photosensitive drum 12K. The exposure head 11K exposes the charged surface of photosensitive drum 12K according to an image signal to form an electrostatic latent image thereon.

Meanwhile, the supply roller 16K supplies toner to the developing roller 15K and the developing roller 15K carries the toner toward the photosensitive drum 12K in the direction B. The toner on the developing roller 15K is formed into a toner layer, which has a uniform thickness, by the developing blade 17K, and carried to a contact portion between the developing roller 15K and the photosensitive drum 12K.

Because of a voltage applied to the developing roller 15K from a high-voltage supply, an electric field by which the toner on the developing roller 15K is attracted to the electrostatic latent image on the photosensitive drum 12K is generated. The developing roller 15K provides the toner to the electrostatic latent image with this electric field, thereby developing the electrostatic latent image on the photosensitive drum 12K by reversal development. In this manner, the toner image is formed on the photosensitive drum 12K.

Next, a printing operation of the printer 1 will be described. As shown in FIG. 1, the sheet P in the sheet cassette 3 is picked up one by one from the sheet cassette 3 by a feed roller, not shown, and transported toward the transport belt 5 along the sheet path 2. The developing operation, mentioned above, is initiated at a predetermined timing before the sheet P reaches the transport belt 5.

When the sheet P reaches the image-forming unit 7K, the transfer roller 8K transfers a black toner image on the photosensitive drum 12K to the sheet P. The transport belt 5 transports the sheet P with the black toner image downstream of the image-forming unit 7K. Similarly to the transfer roller 8K, the transfer rollers 8Y, 8M and 8C respectively transfer a yellow toner image on the photosensitive drum 12Y of the image-forming unit 7Y, a magenta toner image on the photosensitive drum 12M of the image-forming unit 7M, and the cyan toner image on the photosensitive drum 12C of the image-forming unit 7C, to the sheet P in this order. The transport belt 5 further transports the sheet P with the toner images to the fixing unit 9 that lies downstream of the image-forming unit 7C.

In the fixing unit 9, the sheet P is sandwiched between the heat roller 9*a* and the pressure roller 9*b* around which the pressure belt 9*c* is wrapped. The heat roller 9*a* rotates in the direction shown by an arrow D in FIG. 1 and the pressure roller 9*b* rotates in the reverse direction of the direction D. The heat roller 9 whose surface temperature is maintained at a predetermined fixing temperature melts the toner images on the sheet P. At the same time, the pressure roller 9*b* and the pressure belt 9*c* press the toner images. In this manner, the toner images are fixed onto the sheet P. Then, the sheet P is transported along the sheet path 2 and delivered to the stacker 4.

The cleaning unit 20 (20K) removes toner that remains on the photosensitive drum 12 (12K) after the toner image has been transferred to the sheet P. In some cases, improperly-charged toner is directly transferred to the transport belt 5 from the photosensitive drum 12K, 12Y, 12M and 12C. The improperly-charged toner is scraped from the transport belt 5 by the belt cleaning blade 10*a* and collected in the waste toner container 10.

Figure 6A:
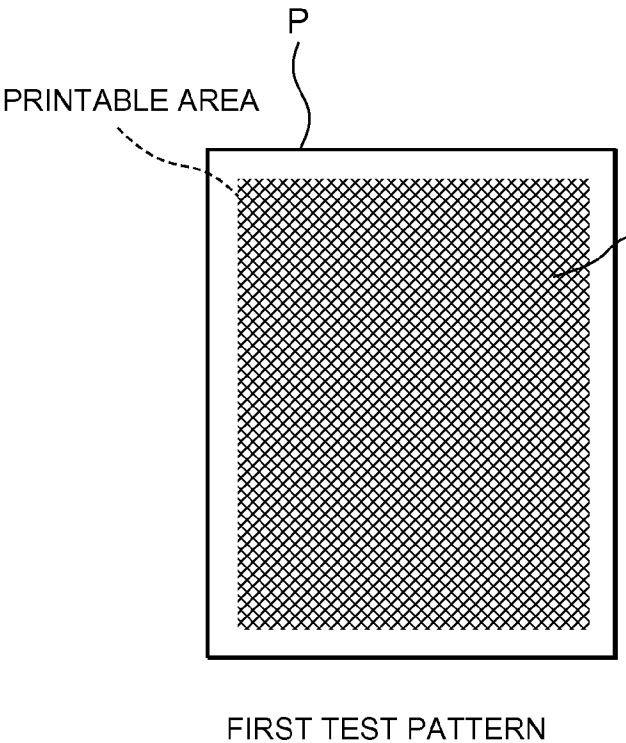
FIG. 6A is a schematic view a first test pattern for evaluation tests of the first embodiment.
Figure 6B:
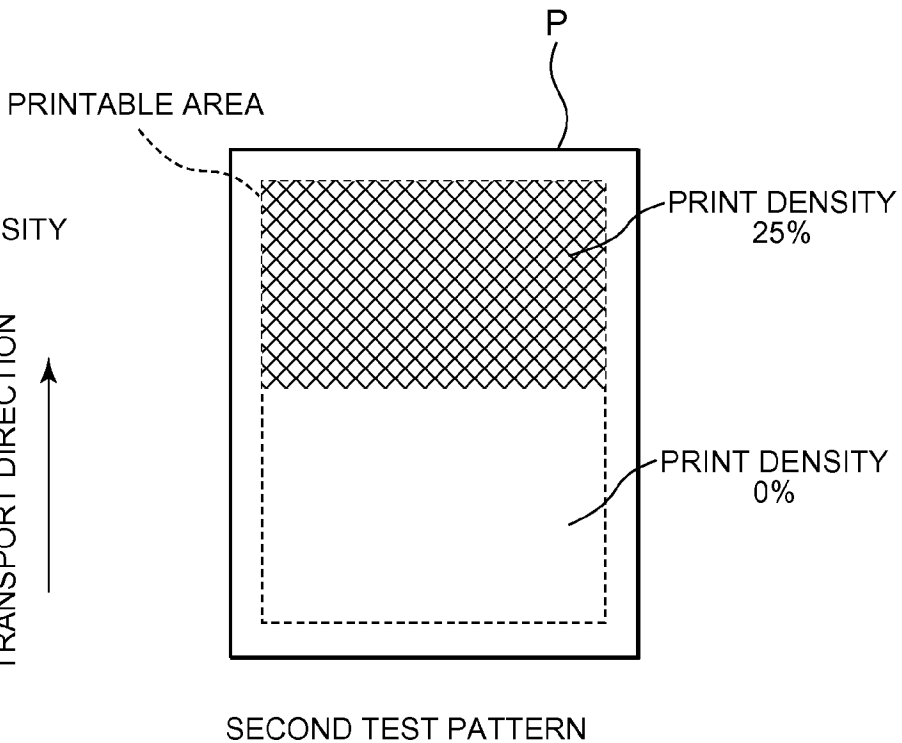
FIG. 6B is a schematic view a second test pattern for the evaluation tests of the first embodiment.

Next, evaluation tests of cleaning performance for the cleaning unit 20K will be described. FIGS. 6A and 6B are respectively schematic views of first and second test patterns for the evaluation tests. FIGS. 7A and 7B are respectively first and second tables that show specification of cleaning units used in the evaluation tests. FIG. 8 is a table that shows results of the evaluation tests.

In the first test pattern of FIG. 6A, a solid image (print density 100%) is formed across the entire area of a printable area of the sheet P. In the second test pattern of FIG. 6B, a halftone image (print density 25%) is formed on the upper half area of the printable area and no image (print density 0%) is formed on the lower half area of the printable area. In addition, the printable area is defined as the whole area of the sheet P except a peripheral area that is 5 mm wide.

Specification 1-1

In specification 1-1, the cleaning member 21 of the cleaning unit 20K is made of urethane rubber, and has a Young's modulus Ec of 0.67 kgf/mm$^2$ (measurement temperature 25° C.), the thickness Tc of 2.0 mm, the width Hc of 6.0 mm and the length Lc of 240 mm. As shown in FIG. 7A, the plate spring 22 is made of stainless steel (SUS 304), and has a Young's modulus Es of 19,000 kgf/mm$^2$, the thickness is of 0.08 mm and the length Ls of 240 mm. The plate spring 22 is L-shaped in cross section where the free length hs is 13.0 mm and the length Zs of the bent portion 23 is 1.5 mm. In addition, the amount of deflection ys of the plate spring 22 is set to 1.81 mm by adjusting a displacement position of the cleaning member 21.

A linear pressure Ws of the cleaning member 21 against the photosensitive drum 12K is calculated as follows:

$$Ws=(Es\cdot ts^3\cdot ys)/(4\cdot hs^3)(\text{gf/mm}) \quad (1)$$

In the specification 1-1, the linear pressure Ws is calculated to be 2.0 gf/mm according to the above formula (I).

The evaluation tests of cleaning performance were conducted on the cleaning unit 20K of the specification 1-1, under test conditions 1 to 4 below.

Test Condition 1

The test condition 1 is as follows:

TEST ENVIRONMENT: temperature 25° C. (room temperature), humidity 50%;

PRINT SPEED: 247 mm/s;

SHEET TYPE: A4 size plain paper, basis weight 80 g/m$^2$ (OKI EXCELLENT WHITE: Oki Data Corp.);

SHEET TRANSPORTATION: portrait;

TRANSPORTATION INTERVAL: 60 mm; and

TONER AVERAGE PARTICLE SIZE: 5.0 μm.

The "PRINT SPEED" is equivalent to a circumferential speed of the photosensitive drum 12K and a transportation speed of the sheet P. The "TRANSPORTATION INTERVAL" is defined as a distance between a back-end of a preceding sheet and a front-end of a following sheet.

Under the above test condition 1, 30,000 prints are consecutively performed with the first test pattern of FIG. 6A, and after that, one print is performed with the second test pattern of FIG. 6B.

As shown in FIG. 8, no image defect occurred on the halftone image of the second test pattern under the above test condition 1. In addition, no adhesion of toner to the charging roller 14K occurred.

Test Condition 2

The test condition 2 is the same as the test condition 1 except the "TEST ENVIRONMENT." The "TEST ENVIRONMENT" of the test condition 2 is as follows:

TEST ENVIRONMENT: temperature 5° C., humidity 10% (low temperature/low humidity environment).

Under the above test condition 2, 30,000 prints were consecutively performed with the first test pattern of FIG. 6A, and after that, one print was performed with the second test pattern of FIG. 6B.

As shown in FIG. 8, no image defect occurred on the halftone image of the second test pattern under the above test condition 2. In addition, no adhesion of toner to the charging roller 14K occurred.

Test Condition 3

The test condition 3 is the same as the test condition 1 except the "TONER AVERAGE PARTICLE SIZE." The "TONER AVERAGE PARTICLE SIZE" of the test condition 3 is as follows:

TONER AVERAGE PARTICLE SIZE: 4.0 μm.

Under the above test condition 3, 30,000 prints were consecutively performed with the first test pattern of FIG. 6A, and after that, one print was performed with the second test pattern of FIG. 6B.

As shown in FIG. 8, no image defect occurred on the halftone image of the second test pattern under the above test condition 3. In addition, no adhesion of toner to the charging roller 14K occurred.

Test Condition 4

The test condition 4 is the same as the test condition 1 except the "TEST ENVIRONMENT" and "TONER AVERAGE PARTICLE SIZE." The "TEST ENVIRONMENT" and "TONER AVERAGE PARTICLE SIZE" of the test condition 4 are as follows:

TEST ENVIRONMENT: temperature 5° C., humidity 10% (low temperature/low humidity environment); and TONER AVERAGE PARTICLE SIZE: 4.0 μm.

Under the above test condition 4, 30,000 prints were consecutively performed with the first test pattern of FIG. 6A, and after that, one print was performed with the second test pattern of FIG. 6B.

As shown in FIG. 8, no image defect occurred on the halftone image of the second test pattern under the above test condition 4. In addition, no adhesion of toner to the charging roller 14K occurred.

As described above, when the linear pressure Ws is 2.0 gf/mm, the cleaning unit 20K of the specification 1-1 is capable of providing good cleaning performance even if the toner has the average particle size equal to or less than 5.0 μm and even if the printer 1 is operated under a low temperature/low humidity environment.

Specification 1-2

In specification 1-2, the amount of deflection ys of the plate spring 22 is set to 1.44 mm by adjusting a displacement position of the cleaning member 21. The other parameters are the same as in the specification 1-1. In this case, the linear pressure Ws is calculated to be 1.6 gf/mm according to the above formula (I).

The evaluation tests of cleaning performance were conducted on the cleaning unit 20K of the specification 1-2, under the test conditions 1 to 4 the same as for the specification 1-1.

Test Condition 1

As shown in FIG. 8, no image defect occurred on the halftone image of the second test pattern under the test condition 1. In addition, no adhesion of toner to the charging roller 14K occurred.

Test Condition 2

As shown in FIG. 8, no image defect occurred on the halftone image of the second test pattern under the test condition 2. In addition, no adhesion of toner to the charging roller 14K occurred.

Test Condition 3

As shown in FIG. 8, no image defect occurred on the halftone image of the second test pattern under the test condition 3. In addition, no adhesion of toner to the charging roller 14K occurred.

Test Condition 4

As shown in FIG. 8, no image defect occurred on the halftone image of the second test pattern under the test condition 3. However, a small amount of toner adhered to the charging roller 14K.

As described above, when the linear pressure Ws of 1.6 gf/mm, the cleaning unit 20K of the specification 1-2 is capable of providing good cleaning performance even if the toner has the average particle size equal to or less than 5.0 μm and even if the printer 1 is operated under a low temperature/low humidity environment.

Comparison Specification 1-1

Figure 9:
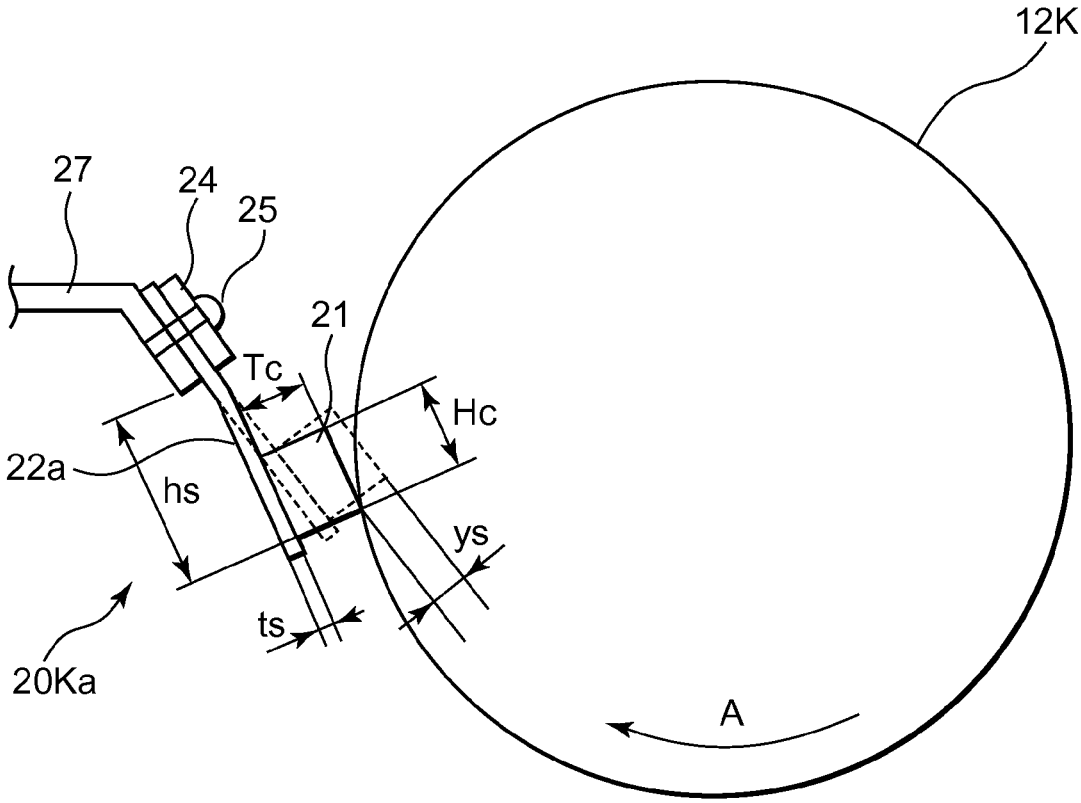
FIG. 9 is a schematic view of a cleaning unit of comparison specification 1-1 of the first embodiment.

FIG. 9 is a schematic view of a cleaning unit 20Ka of the comparison specification 1-1. In FIG. 9, symbols Hc and Tc respectively denote the width and the thickness of the cleaning member 21. In addition, symbols hs, ys and is respectively denote the free length, the amount of deflection and the thickness of a plate spring 22*a*.

Similarly to the specification 1-1, in the comparison specification 1-1, the cleaning member 21 of the cleaning unit 20Ka is made of urethane rubber, and has a Young's modulus Ec of 0.67 kgf/mm$^2$ (measurement temperature 25° C.), the thickness Tc of 2.0 mm, the width Hc of 6.0 mm and the length Lc of 240 mm. As shown in FIG. 7A, the plate spring

22*a* is made of stainless steel (SUS 304), and has a Young's modulus Es of 19,000 kgf/mm$^2$, the thickness is of 0.08 mm, the length Ls of 240 mm and the free length hs of 13.0 mm. It should be noted that the plate spring 22*a* is flat in shape, i.e., the plate spring 22*a* does not have the bent portion 23. The amount of deflection ys of the plate spring 22*a* is set to 1.81 mm by adjusting a displacement position of the cleaning member 21. In this case, the linear pressure Ws of the cleaning member 21 against the photosensitive drum 12K is calculated to be 2.0 gf/mm according to the above formula (I).

The evaluation tests of cleaning performance were conducted on the cleaning unit 20Ka of the comparison specification 1-1, under the test conditions 1 to 4 the same as for the specification 1-1.

Test Condition 1

As shown in FIG. 8, no image defect occurred on the halftone image of the second test pattern under the test condition 1. In addition, no adhesion of toner to the charging roller 14K occurred.

Test Condition 2

As shown in FIG. 8, vertical streaks, which were not part of the second test pattern, appeared in places on the halftone image of the second test pattern, i.e., image defects occurred on the second test pattern under the test condition 2. In addition, toner adhered to surface portions, which corresponded to the vertical streaks, of the charging roller 14K due to insufficient cleaning.

Test Condition 3

As shown in FIG. 8, no image defect occurred on the halftone image of the second test pattern under the test condition 3. However, a small amount of toner adhered to the charging roller 14K.

Test Condition 4

As shown in FIG. 8, vertical streaks, which were not part of the second test pattern, appeared in places on the halftone image of the second test pattern, i.e., image defects occurred on the second test pattern under the test condition 4. In addition, toner adhered to surface portions, which corresponded to the vertical streaks, of the charging roller 14K due to insufficient cleaning.

As described above, in the cleaning unit 20Ka of the comparison specification 1-1, insufficient cleaning occurred under a low temperature/low humidity environment. This was because deformation of the cleaning member 21 occurred such that the cleaning member was no longer linear and parallel to the axis of the drum, which caused the pressure of the cleaning member 21 against the photosensitive drum 12K to vary. Therefore, the toner on the photosensitive drum 12K passed between the cleaning member 21 and the photosensitive drum 12K, under the low temperature/low humidity environment.

Comparison Specification 1-2

In comparison specification 1-2, the amount of deflection ys of the plate spring 22*a* is set to 1.44 mm by adjusting a displacement position of the cleaning member 21. The other parameters are the same as in the comparison specification 1-1. In this case, the linear pressure Ws is calculated to be 1.6 gf/mm according to the above formula (I).

The evaluation tests of cleaning performance were conducted on the cleaning unit 20Ka of the comparison specification 1-2, under the test conditions 1 to 4 the same as for the specification 1-1.

Test Condition 1

As shown in FIG. 8, no image defect occurred on the halftone image of the second test pattern under the test condition 1. However, a small amount of toner adhered to the charging roller 14K.

Test Condition 2

As shown in FIG. 8, no image defect occurred on the halftone image of the second test pattern under the test condition 2. However, a small amount of toner adhered to the charging roller 14K.

Test Condition 3

As shown in FIG. 8, no image defect occurred on the halftone image of the second test pattern under the test condition 3. However, a small amount of toner adhered to the charging roller 14K.

Test Condition 4

As shown in FIG. 8, vertical streaks, which were not part of the second test pattern, appeared in places on the halftone image of the second test pattern, i.e., image defects occurred on the second test pattern under the test condition 4. In addition, toner adhered to surface portions, which corresponded to the vertical streaks, of the charging roller 14K due to insufficient cleaning. Moreover, toner fused onto the photosensitive drum 12K, resulting in toner filming on the photosensitive drum 12K.

Comparison Specifications 1-3

Figure 10:
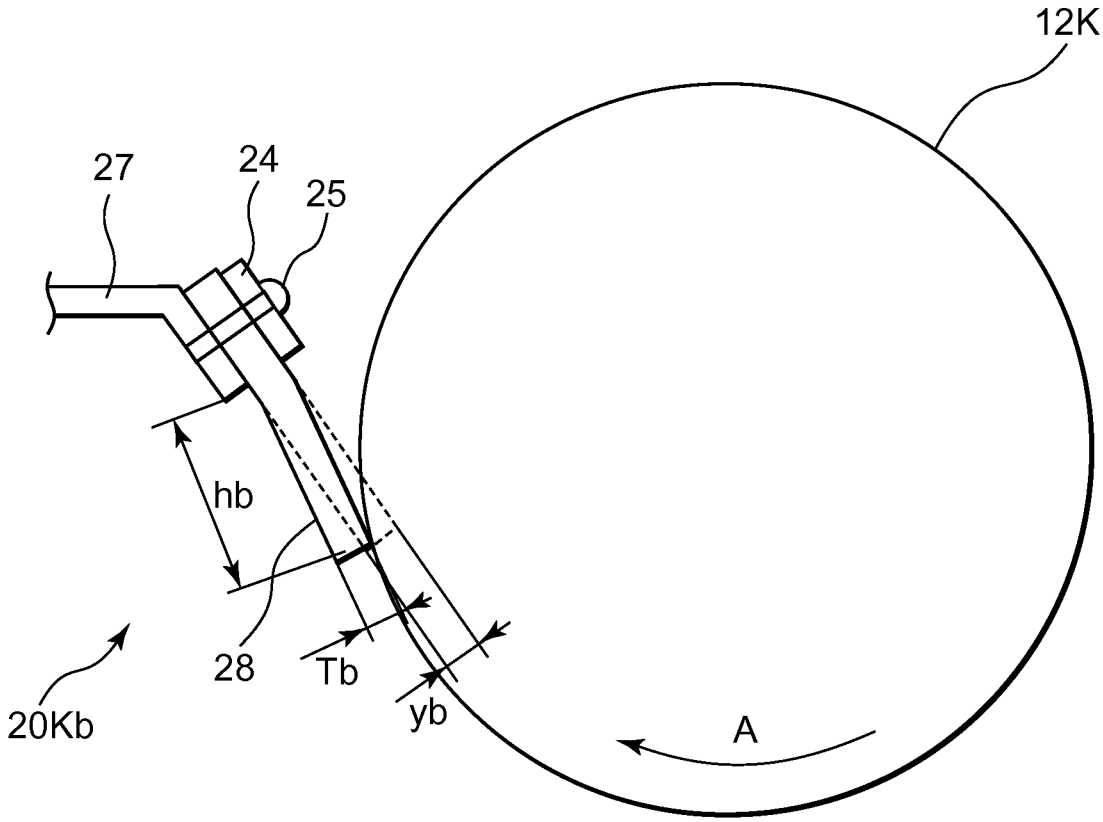
FIG. 10 is a schematic view of a cleaning unit of comparison specification 1-3 of the first embodiment.

FIG. 10 is a schematic view of a cleaning unit 20Kb of comparison specification 1-3. In the comparison specification 1-3, the cleaning unit 20Kb only includes a cleaning member 28 that is flat in shape. In FIG. 10, symbols Tb, hb and yb respectively denote the thickness, the free length and the amount of deflection of the cleaning member 28.

As shown in FIG. 7B, in the comparison specification 1-3, the cleaning member 28 of the cleaning unit 20Kb is made of urethane rubber, and has a Young's modulus Eb of 0.67 kgf/mm$^2$ at a temperature of 25° C. and at a humidity of 50%. The cleaning member 28 also has the thickness Tb of 1.6 mm, the length Lb of 240 mm and the free length hb of 7.0 mm. The amount of deflection yb of the cleaning member 28 is set to 1.00 mm by adjusting a displacement position of the cleaning member 28. In this case, a linear pressure Wb of the cleaning member 28 against the photosensitive drum 12K is calculated to be 2.0 gf/mm according to the above formula (I).

The evaluation tests of cleaning performance were conducted on the cleaning unit 20Kb of the comparison specification 1-3, under the test conditions 1 to 4 the same as for the specification 1-1.

Test Condition 1

As shown in FIG. 8, no image defect occurred on the halftone image of the second test pattern under the test condition 1. However, a small amount of toner adhered to the charging roller 14K.

Test Condition 2

As shown in FIG. 7B, the cleaning member 28 made of urethane rubber has the Young's modulus Eb of 0.80 kgf/mm$^2$ under the test condition 2, i.e., at a temperature of 5° C. and at a humidity of 10% (low temperature/low humidity environment). In this case, the linear pressure Wb of the cleaning member 28 against the photosensitive drum 12K is calculated to be 2.4 gf/mm according to the above formula (I).

As shown in FIG. 8, vertical streaks, which were not part of the second test pattern, appeared in places on the halftone image of the second test pattern, i.e., image defects occurred on the second test pattern under the test condition 2. In addition, toner adhered to surface portions, which correspond to the vertical streaks, of the charging roller 14K due to insufficient cleaning. Moreover, toner fused onto the photosensitive drum 12K, resulting in toner filming on the photosensitive drum 12K.

This was because large friction force, caused by the increase in the linear pressure Wb, was applied to toner on the photosensitive drum 12K, and then the toner fused onto the photosensitive drum 12K, and therefore the cleaning was insufficient under a low temperature/low humidity environment.

Test Condition 3

As shown in FIG. 7B, the cleaning member 28 made of urethane rubber has the Young's modulus Eb of 0.67 kgf/mm$^2$ under the test condition 3, i.e., at a temperature of 25° C. and at a humidity of 50%. In this case, the linear pressure Wb of the cleaning member 28 against the photosensitive drum 12K is calculated to be 2.0 gf/mm according to the above formula (I).

As shown in FIG. 8, vertical streaks, which were not part of the second test pattern, appeared in places on the halftone image of the second test pattern, i.e., image defects occurred on the second test pattern under the test condition 3. In addition, toner adhered to surface portions, which correspond to the vertical streaks, of the charging roller 14K due to insufficient cleaning.

This was because a pressure of the cleaning member 28 against the photosensitive drum 12K varied, and therefore the toner that has a small average particle size passed between the cleaning member 28 and the photosensitive drum 12K.

Test Condition 4

As shown in FIG. 7B, the cleaning member 28 made of urethane rubber has the Young's modulus Eb of 0.80 kgf/mm$^2$ under the test condition 4, i.e., at a temperature of 5° C. and at a humidity of 10% (low temperature/low humidity environment). In this case, the linear pressure Wb of the cleaning member 28 against the photosensitive drum 12K is calculated to be 2.4 gf/mm according to the above formula (1).

As shown in FIG. 8, vertical streaks, which were not part of the second test pattern, appeared in places on the halftone image of the second test pattern, i.e., image defects occurred on the second test pattern under the test condition 4. In addition, toner adhered to surface portions, which correspond to the vertical streaks, of the charging roller 14K due to insufficient cleaning. Moreover, toner fused onto the photosensitive drum 12K, resulting in toner filming on the photosensitive drum 12K.

As is the case with the above test condition 2, this was because large friction force, caused by the increase in the linear pressure Wb, was applied to toner on the photosensitive drum 12K, and then the toner fused onto the photosensitive drum 12K, and therefore insufficient cleaning occurred, under a low temperature/low humidity environment.

The results of the evaluation tests of cleaning performance show that the cleaning unit 20K of the first embodiment is capable of preventing the variation in pressure of the cleaning member 21 against the photosensitive drum 12K even if the usage environment of the printer 1 has changed. The results also show that the cleaning unit 20K is capable of providing good cleaning performance even if toner has a small average particle size.

As described above, in the first embodiment, the plate spring 22 has the bent portion 23 at the free end opposed to the photosensitive drum 12K, and supports the cleaning member 21 on the inside of the bent portion 23. Therefore, the cleaning unit 20K is capable of enhancing the rigidity of the plate spring 22, which prevents deformation of the cleaning member 21. That is, the bent portion 23 serves to keep the cleaning member 21 linear and parallel to the axis of the photosensitive drum 12K. Therefore, the cleaning unit 20K is capable of preventing the variation in pressure of the cleaning member 21 against the photosensitive drum 12K even if the usage environment of the printer 1 has changed. In addition, the cleaning unit 20K is also capable of providing good cleaning performance even if toner has a small average particle size. Thus, the cleaning unit 20K of the first embodiment is capable of preventing loss of print quality.

Second Embodiment

Figure 11:
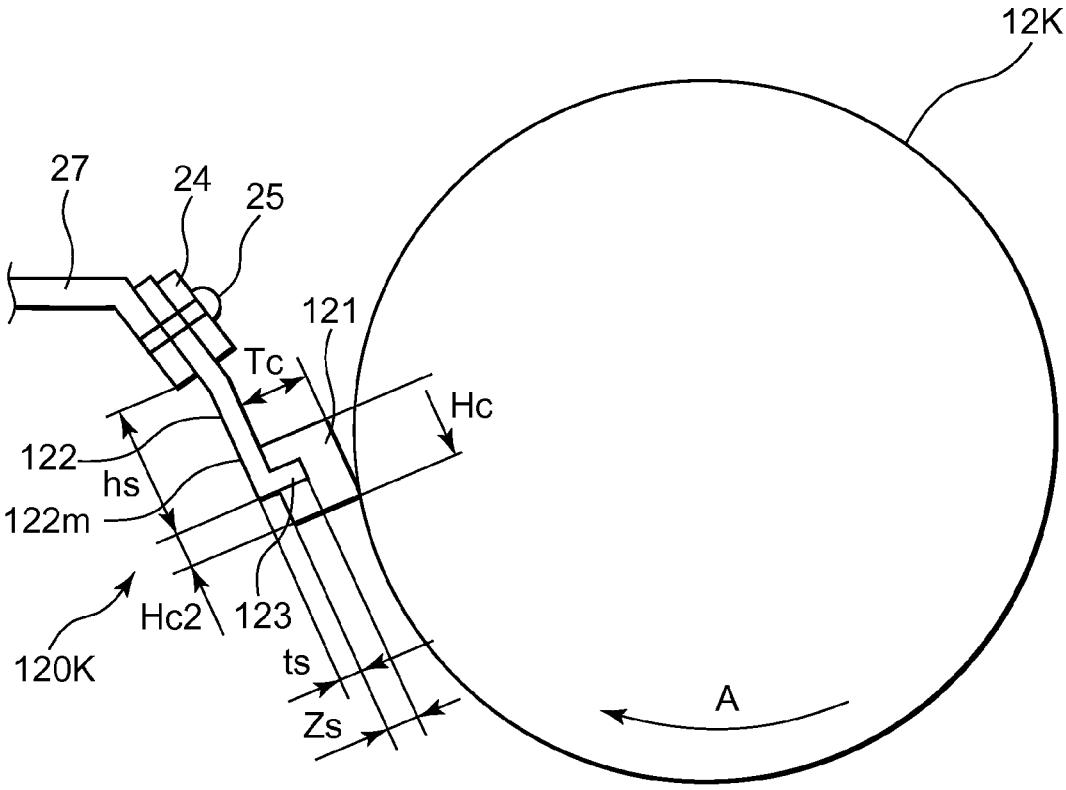
FIG. 11 is a schematic view of a cleaning unit of a second embodiment.
Figure 12:
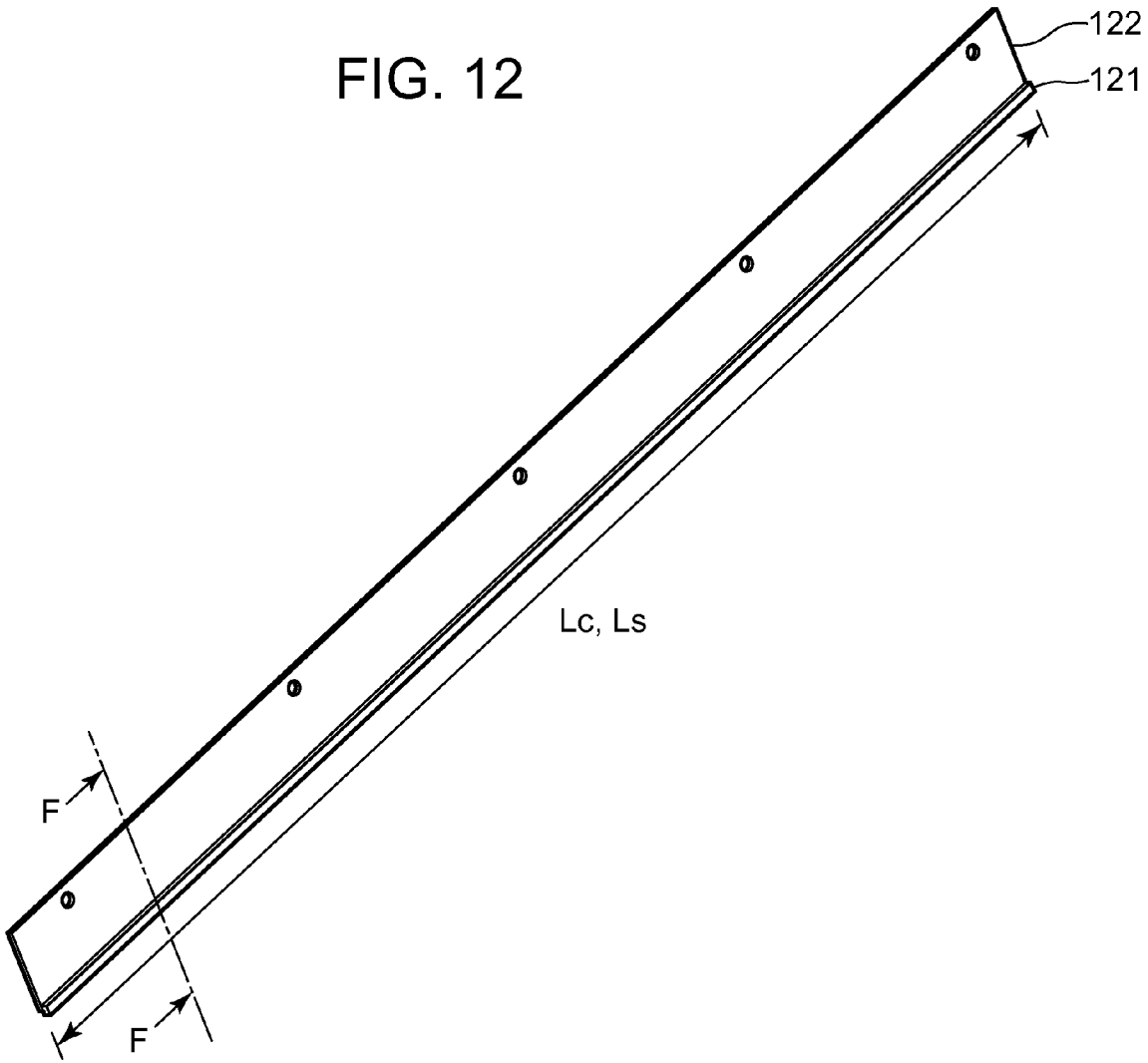
FIG. 12 is a perspective view of a cleaning member and a plate spring of the cleaning unit of the second embodiment.
Figure 13:
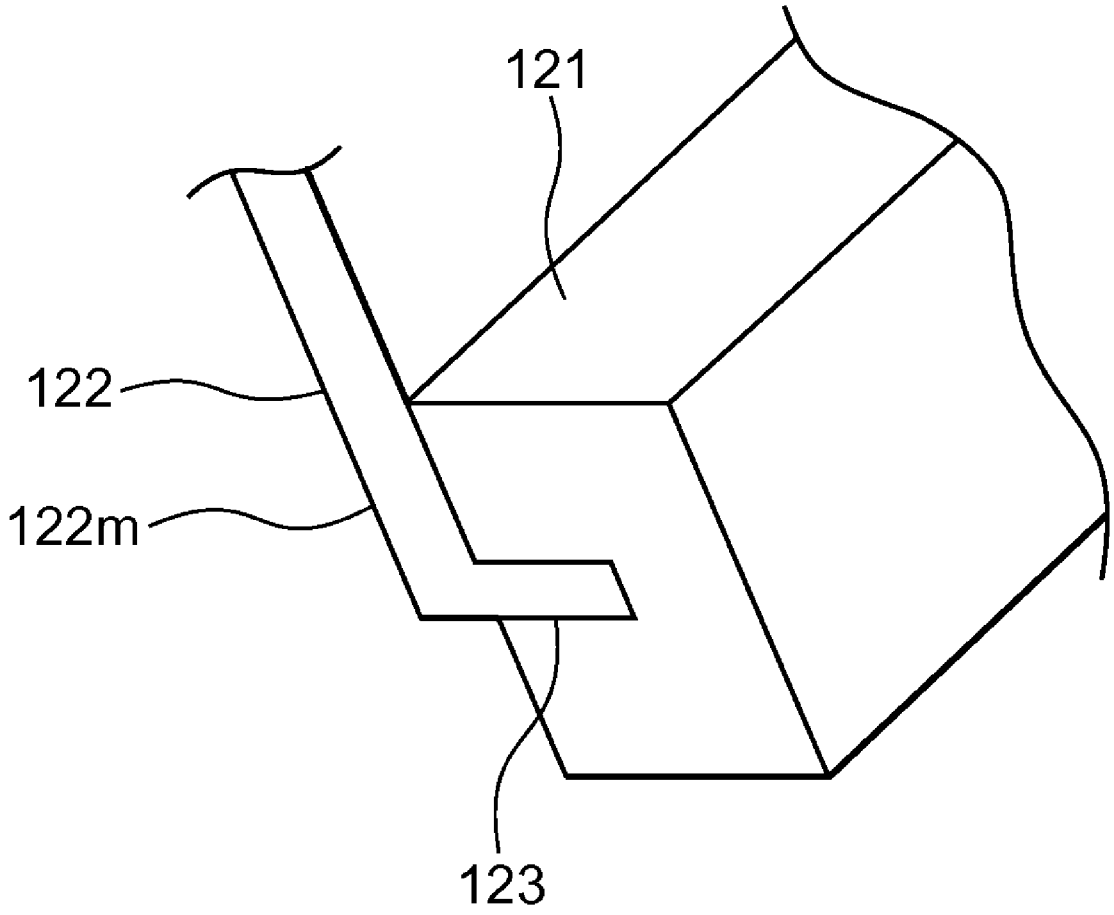
FIG. 13 is a cross-sectional perspective view of the cleaning member and the plate spring along the line F-F of FIG. 12.

FIG. 11 is a schematic view of a cleaning unit 120K according to a second embodiment, which includes a cleaning member 121, a plate spring 122 and the base frame 27. FIG. 12 is a perspective view of the cleaning member 121 and the plate spring 122 of the cleaning unit 120K. FIG. 13 is a cross-sectional perspective view of the cleaning member 121 and the plate spring 122 along the line F-F of FIG. 12. In the second embodiments, elements similar to those in the first embodiment have been given the same numerals and their description is partially omitted.

As shown in FIG. 11, the cleaning member 121 as a developer removal member is in sliding contact with the photosensitive drum 12K. As shown in FIG. 12, the cleaning member 121, which has elasticity, is substantially rectangular in shape. The cleaning member 121 has a length Lc that is substantially the same as a length of the photosensitive drum 12K in its longitudinal direction. In the second embodiment, the cleaning member 121 is made of urethane rubber. In FIG. 11, symbols Hc and Tc respectively denote the width and the thickness of the cleaning member 121. In addition, a symbol Hc2 denotes the distance between an end portion of the cleaning member 121 in contact with the photosensitive drum 12K and a bent portion 123, described later, i.e., a projection length of the cleaning member 121.

The plate spring 122 serves as a support member, which supports the cleaning member 121, is flexible and is substantially L-shaped in cross section as shown in FIG. 11. The plate spring 122 essentially includes a body member 122*m* and the bent portion 123. The bent portion 123 extends approximately at a right angle with respect to the body member 122*m*. The bent portion 123 is located at a first end i.e., a free end, opposed to the photosensitive drum 12K. In the second embodiment, the cleaning member 121 and the plate spring 122 are integrally formed so that the bent portion 123 is embedded in the cleaning member 121.

A second end of the plate spring 122, which is opposite to the first end (the free end), is sandwiched between the base frame 27, which serves as a fixation member, and a fixation plate 24. The second end is fixed to the base frame 27 with a screw 25. In addition, as shown in FIG. 12, the plate spring 122 has a length Ls that is substantially the same as the length of the photosensitive drum 12K in its longitudinal direction. In FIG. 11, symbols hs and is respectively denote the free length and the thickness of the plate spring 122, and a symbol Zs denotes the length of the bent portion 123.

Next, evaluation tests of cleaning performance and of image deterioration for the cleaning unit 120K will be described. FIG. 14 is a table that shows a specification of cleaning units used in the evaluation tests. FIG. 15 is a table that shows results of the evaluation tests.

In the second embodiment, under the same test condition as those in the first embodiment, 60,000 prints are consecutively performed with the first test pattern of FIG. 6A, and after that, one print is performed with the second test pattern of FIG. 6B. In addition to the evaluation tests of cleaning performance the same as those in the first embodiment, an abrasion state of the resin layer of the photosensitive drum 12K is evaluated. The thickness of the resin layer, i.e., a distance from the peripheral surface of the aluminum cylinder of the photosensitive drum 12K to the peripheral surface of the photosensitive drum 12K can be measured with an eddy-current thickness tester (LH-330J: Kett Electric Laboratory Co., Ltd.). The amount of abrasion Δd of the resin layer is calculated by subtracting the thickness de of the resin layer measured after the 60,000 prints from the initial thickness ds (18.0 μm) of the resin layer measured before the 60,000 prints.

Specification 2-1

In specification 2-1, the cleaning member 121 of the cleaning unit 120K is made of urethane rubber, and has a Young's modulus Ec of 0.67 kg f/mm$^2$ (measurement temperature 25° C.), the thickness Tc of 2.0 mm, the width Hc of 3.0 mm, the length Lc of 240 mm and the projection length Hc2 of 1.5 mm. As shown in FIG. 14, the plate spring 122 is made of stainless steel (SUS 304), and has a Young's modulus Es of 19,000 kgf/mm$^2$, the thickness is of 0.08 mm and the length Ls of 240 mm. The plate spring 122 is L-shaped in cross section where the free length hs is 13.0 mm and the length Zs of the bent portion 23 is 1.5 mm. In addition, the amount of deflection ys of the plate spring 122 is set to 1.05 mm, 1.44 mm or 1.81 mm by adjusting a displacement position of the cleaning member 121. Linear pressures Ws corresponding to the amount of deflection ys of 1.05 mm, 1.44 mm and 1.81 mm are respectively calculated to be 1.2 gf/mm, 1.6 gf/mm and 2.0 gf/mm according to the above formula (I).

The evaluation tests of cleaning performance and of image deterioration were conducted on the cleaning unit 120K of the specification 2-1, for each of the amount of deflection ys of 1.05 mm, 1.44 mm and 1.81 mm.

In the case where the amount of deflection ys is 1.05 mm, i.e., the linear pressure Ws is 1.2 gf/mm, no image defect occurred on the halftone image of the second test pattern, as shown in FIG. 15. In addition, no adhesion of toner to the charging roller 14K occurred. Moreover, no image deterioration occurred on the second test pattern. The thickness de of the resin layer after the 60,000 prints was 12.9 μm, and therefore the amount of abrasion Δd (=ds−de) of the resin layer was 5.1 μm.

In the case where the amount of deflection ys is 1.44 mm, i.e., the linear pressure Ws is 1.6 gf/mm, no image defect occurred on the halftone image of the second test pattern, as shown in FIG. 15. In addition, no adhesion of toner to the charging roller 14K occurred. Moreover, no image deterioration occurred on the second test pattern. The thickness de of the resin layer after the 60,000 prints was 12.0 μm, and therefore the amount of abrasion Δd (=ds−de) of the resin layer was 6.0 μm.

In the case where the amount of deflection ys is 1.81 mm, i.e., the linear pressure Ws is 2.0 gf/mm, no image defect occurred on the halftone image of the second test pattern, as shown in FIG. 15. In addition, no adhesion of toner to the charging roller 14K occurred. Moreover, no image deterioration occurred on the second test pattern. The thickness de of the resin layer after the 60,000 prints was 11.1 μm, and therefore the amount of abrasion Δd (=ds−de) of the resin layer was 6.9 μm.

Comparison Specifications 2-1

Comparison specification 2-1 is the same as the specification 1-1 of the first embodiment. That is to say, the plate spring 22 of the cleaning unit 20K has the bent portion 23 and supports the cleaning member 21 on the inside of the bent portion 23, as shown in FIG. 3.

The evaluation tests of cleaning performance and of image deterioration were conducted on the cleaning unit 20K of the comparison specification 2-1 (specification 1-1), for each of the amount of deflection ys of 1.05 mm, 1.44 mm and 1.81 mm.

In the case where the amount of deflection ys is 1.05 mm, i.e., the linear pressure Ws is 1.2 gf/mm, image defects occurred on the second test pattern, as shown in FIG. 15. In addition, toner adhered to surface portions of the charging roller 14K due to insufficient cleaning. However, no image deterioration occurred on the second test pattern. The thickness de of the resin layer after the 60,000 prints was 12.0 μm, and therefore the amount of abrasion Δd (=ds−de) of the resin layer was 6.0 μm.

In the case where the amount of deflection ys is 1.44 mm, i.e., the linear pressure Ws is 1.6 gf/mm, no image defect occurred on the halftone image of the second test pattern, as shown in FIG. 15. However, a small amount of toner adhered to the charging roller 14K. In addition, image density of the halftone image became high as a whole, and a microscope image showed that each dot of the halftone image was broader than that in a normal condition. The thickness de of the resin layer after the 60,000 prints was 9.7 μm, and therefore the amount of abrasion Δd (=ds−de) of the resin layer was 8.3 μm. These facts show that the photosensitive drum 12K is not properly charged due to a reduction in thickness of the resin layer of the photosensitive drum 12K.

In the case where the amount of deflection ys is 1.81 mm, i.e., the linear pressure Ws is 2.0 gf/mm, no image defect occurred on the halftone image of the second test pattern, as shown in FIG. 15. In addition, no adhesion of toner to the charging roller 14K occurred. However, an unwanted toner image was developed on the halftone area and on the area where no image to be developed. That is to say, image deterioration occurred on the second test pattern. The thickness de of the resin layer after the 60,000 prints was 8.1 μm, and therefore the amount of abrasion Δd (=ds−de) of the resin layer was 9.9 μm. These facts show that the photosensitive drum 12K is not properly charged due to a reduction in thickness of the resin layer of the photosensitive drum 12K.

The results of the evaluation tests show that the cleaning unit 120K of the second embodiment is capable of preventing the photosensitive drum 12K from being improperly charged due to the abrasion of the resin layer even if the printer 1 is used over long periods.

As described above, in the second embodiment, the plate spring 122 has the bent portion 123 at the free end opposed to the photosensitive drum 12K, and the bent portion 123 is embedded in the cleaning member 121. Therefore, the cleaning unit 120K is capable of preventing the resin layer of the photosensitive drum 12K from being abraded by the cleaning member 121. And therefore, the cleaning unit 120K is capable of preventing loss of print quality more effectively than the cleaning unit 20K of the first embodiment. In addition, the cleaning unit 120K is capable of improving durability of the image-forming units 7K.

In each of the embodiments, the linear pressure Ws of the cleaning member 21 (121) against the photosensitive drum 12K should be in the range of 1.6 gf/mm to 2.0 gf/mm. If the linear pressure Ws is less than 1.6 gf/mm, image defects occur due to insufficient cleaning. On the other hand, if the linear pressure Ws is more than 2.0 gf/mm, toner fuses onto the photosensitive drum 12K, resulting in toner filming on the photosensitive drum 12K.

In addition, the thickness ts of the plate spring 22 (122) should be in the range of 0.05 mm to 0.10 mm. If the thickness ts is less than 0.05 mm, the cleaning member 21 (121) is liable to be deformed due to accumulation of toner on the cleaning member 21 (121). On the other hand, if the thickness ts is more than 0.10 mm, large friction force acts on toner on the photosensitive drum 12K, resulting in toner filming. Moreover, a rotational load on the photosensitive drum 12K increases and this makes it difficult to form toner image properly on the photosensitive drum 12K.

Furthermore, the Young's modulus Ec of the cleaning member 21 (121) should be in the range of 0.50 kgf/mm$^2$ to 1.00 kgf/mm$^2$ (measurement temperature 25° C.)

While each of the embodiments has been described with respect to a case where the cleaning unit 20K (120K) is used for cleaning of the photosensitive drum 12K, the cleaning unit 20K (120K) may be used for cleaning of a belt member such as the transport belt 5, or of a roller such as the transfer roller 8K or the charging roller 14K. In addition, while each of the embodiments has been described with respect to an electrophotographic printer, the invention may be applicable to a copier, a facsimile machine or a multifunction peripheral (MFP).

The cleaning device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A cleaning device comprising:

a developer removal member that is in contact with an adherend to which developer adheres and removes the developer from the adherend;

a support member, which includes a first end at which a support part and a bent portion are formed, and a second end, which is opposite to the first end, the bent portion being bent at a predetermined angle with respect to the support part and extending toward the adherend; and a fixation member that holds the second end of the support member, wherein the support part includes a first surface facing the adherend, the bent part includes a second surface continuous from the first surface, and the developer removal member is supported on the support member by at least the first surface and the second surface.

2. The cleaning device according to claim 1, wherein the developer removal member has elasticity.

3. The cleaning device according to claim 1, wherein the support member has flexibility.

4. The cleaning device according to claim 1, wherein the support member has a thickness in the range of 0.05 mm to 0.10 mm.

5. The cleaning device according to claim 1, wherein a linear pressure of the developer removal member against the adherend is in the range of 1.6 gf/mm to 2.0 gf/mm.

6. The cleaning device according to claim 1, wherein the developer has an average particle size of 4.0 μm to 5.0 μm.

7. The cleaning device according to claim 1, wherein the adherend is an image bearing body.

8. The cleaning device according to claim 1, wherein the bent portion is embedded in the developer removal member.

9. An image forming apparatus comprising:

an adherend to which developer adheres;

a developer removal member that is in contact with the adherend and removes the developer from the adherend;

a support member, which includes a first end at which a support part and a bent portion are formed, and a second end, which is opposite to the first end, the bent portion being bent at a predetermined angle with respect to the support part and extending towards the adherend; and a fixation member that holds the second end of the support member, wherein the support part includes a first surface facing the adherend, the bent part includes a second surface continuous from the first surface, and the developer removal member is supported on the support member by at least the first surface and the second surface.

10. The image forming apparatus according to claim 9, wherein the developer removal member has elasticity.

11. The image forming apparatus according to claim 9, wherein the support member has flexibility.

12. The image forming apparatus according to claim 9, wherein the support member has a thickness in the range of 0.05 mm to 0.10 mm.

13. The image forming apparatus according to claim 9, wherein a linear pressure of the developer removal member against the adherend is in the range of 1.6 gf/mm to 2.0 gf/mm.

14. The image forming apparatus according to claim 9, wherein the developer has an average particle size of 4.0 μm to 5.0 μm.

15. The image forming apparatus according to claim 9, wherein the adherend is an image bearing body.

16. The image forming apparatus according to claim 15, wherein the image bearing body has a photoconductive resin layer.

17. The image forming apparatus according to claim 9, wherein the bent portion is embedded in the developer removal member.

18. A cleaning device comprising:

a developer removal member, which is adapted to contact a movable surface to which developer toner adheres, has a longitudinal axis that is transverse to a moving direction of the movable surface, and wipes and removes the developer toner from the movable surface;

a plate spring, which includes a fixed side, a movable side, and a bent portion, wherein the fixed side is opposite to the movable side, the developer removal member is fixed to the movable side of the plate spring, and the plate spring includes a body member and the bent portion, the bent portion is located at the movable side of the plate spring, is proximal to and substantially coextensive with the developer removal member, and extends generally at a right angle with respect to the body member; and a fixation member that holds the fixed side of the plate spring in a stationary position, wherein the body member includes a first surface facing the movable surface, the bent part includes a second surface continuous from the first surface, and the developer removal member is supported on the plate spring by at least the first surface and the second surface.

19. The cleaning device according to claim 18, wherein the plate spring has a cross sectional shape that is substantially L-shaped.

20. The cleaning device according to claim 18, wherein the bent portion is embedded in the developer removal member.

* * * * *